US006207009B1

(12) United States Patent
Hansen et al.

(10) Patent No.: US 6,207,009 B1
(45) Date of Patent: Mar. 27, 2001

(54) METHOD OF TREATING MECHANICAL PULP WITH A PHENOL-OXIDIZING ENZYME SYSTEM

(75) Inventors: Tomas Tage Hansen, Allerød; Peder Holk Nielsen, Veksø, both of (DK)

(73) Assignee: Novo Nordisk Biochem North America, Inc., Franklinton, NC (US)

( * ) Notice: Subject to any disclaimer, the term of this patent is extended or adjusted under 35 U.S.C. 154(b) by 0 days.

(21) Appl. No.: 08/874,802

(22) Filed: Jun. 13, 1997

Related U.S. Application Data

(63) Continuation of application No. 08/338,456, filed as application No. PCT/DE93/00168 on May 18, 1993, now abandoned.

(30) Foreign Application Priority Data

May 18, 1992 (DK) ..... 0640/92

(51) Int. Cl.[7] ..... D21H 25/02

(52) U.S. Cl. ..... 162/9; 162/24; 162/72; 435/278

(58) Field of Search ..... 162/72, 9, 28, 162/25, 26; 435/277, 270

(56) References Cited

U.S. PATENT DOCUMENTS

| | | | | |
|---|---|---|---|---|
| 4,687,745 | | 8/1987 | Farrell | 435/278 |
| 5,273,896 | * | 12/1993 | Pedersen et al. | 162/72 |
| 5,505,772 | | 4/1996 | Kharazipour et al. | 106/163.1 |

FOREIGN PATENT DOCUMENTS

| | | | | |
|---|---|---|---|---|
| 0 345 715 | | 6/1989 | (EP) . | |
| 0 433 258 A1 | | 12/1990 | (EP) . | |
| 0 429 422 | * | 5/1991 | (EP) | 162/72 |
| WO 92/20857 | | 11/1992 | (WO) . | |

OTHER PUBLICATIONS

Trotter, "Biothechnology in the pulp and paper industry: a review, Part 2"; Tappi J., pp. 201–205, May 1990.*

Haars, "Room–Temperature Curing Adhesives Band on Lignin and Phenoloxidases", Inst. of Forest Butany, 1989; p. 126–134.

* cited by examiner

*Primary Examiner*—Steve Alvo
(74) *Attorney, Agent, or Firm*—Steve Zelson, Esq.; Valeta Gregg, Esq.; Reza Green, Esq.

(57) ABSTRACT

A process for producing paper or paperboard from mechanical pulp, in which the pulp is treated with a phenol-oxidizing enzyme after mechanical refining of the pulp has been completed. The resulting paper exhibits an increased strength relative to paper produced from untreated pulp.

8 Claims, No Drawings

METHOD OF TREATING MECHANICAL PULP WITH A PHENOL-OXIDIZING ENZYME SYSTEM

This application is a continuation of U.S. application Ser. No. 08/338,456, filed Nov. 10, 1994 now abandoned, which is a 371 national phase application of PCT/DK93/00168, filed May 18, 1993.

TECHNICAL FIELD

This invention relates to a process for production of paper or paperboard of increased strength from mechanical pulp.

BACKGROUND ART

Mechanical pulp, such as ground wood pulp, refined mechanical pulp, thermomechanical pulp, etc. is generally produced by grinding logs or chips in a grinder or refiner where the temperature increases to near or above boiling. The three main constituents of the pulp are cellulose, hemicellulose and lignin.

From these types of pulp, paper or paperboard is generally manufactured as follows:

The pulp is treated in a screening process, is mixed with paper or paperboard making additives in the stock preparation section in order to prepare the paper or paperboard furnish. A paper or paperboard is then made from the furnish on a paper machine.

The mechanical pulps have an advantage of providing high yield but on the other hand they have inferior strength properties compared to chemical pulps.

High paper strength is generally desirable. Conventional methods for increasing the paper strength include the use of wet strength additives and binders.

EP,A1,0 433 258 discloses a process for the production of mechanical pulp from a fibrous product wherein the fibrous product is subjected to an enzymatic treatment in which a binding agent is linked with the lignin in the fibrous product. The binding agent may be a hydrophilic substance, particularly a protein or a carbohydrate, e.g., oxidized, medium cationic starch. The enzymatic treatment may be done with a laccase.

U.S. Pat. No. 4,687,745 discloses a process for enhancing the strength properties of mechanical pulps. The process uses ligninolytic enzymes present in the extracellular growth medium of a fermentation of *Phanerochaete chrysosporium.*

STATEMENT OF THE INVENTION

We have found that, surprisingly, the strength of the paper of paperboard can be increased by treating the pulp with a phenol-oxidizing enzyme system (e.g. laccase and oxygen) after the mechanical refining. It is believed that this strengthening is due to polymerization or cross-linking of the lignin present at the surface of the fibers.

Accordingly, the invention provides a process for increasing the strength of a mechanical pulp for paper or paperboard production, comprising treating the pulp with a phenol-oxidizing enzyme system, selected from the group consisting of:

a) a peroxidase together with hydrogen peroxide, and b) a laccase or a catechol oxidase together with oxygen, provided that no grinding or refining occurs during this treatment, and that no binding agent is present during this treatment.

EP 429,422 discloses reduction of energy consumption in the refining stages by use of laccase during pulp preparation between the first and second refining stage; the document indicates that some increase of paper strength is also obtained. However, the enzyme treatment is done at 20° C., so this prior-art process requires an extra cooling stage after the first refining step. The process of this invention would obviously defeat the object of EP 429,422 as the enzyme treatment occurs after the last refining stage and therefore has no effect on energy consumption during refining.

DETAILED DESCRIPTION OF THE INVENTION

Phenol Oxidizing Enzyme System

The enzyme system used in the invention consists of a suitable oxidase together with $O_2$ or a suitable peroxidase together with $H_2O_2$. Suitable enzymes are those which oxidize and polymerize aromatic compounds such as phenols and lignin.

Examples of suitable enzymes are catechol oxidase (EC 1.10.3.1), laccase (EC 1.10.3.2) and peroxidase (EC 1.11.1.7). Some preferred enzymes are peroxidase derived from a strain of Coprinus, e.g. *C. cinerius* or *C. macrorhizus,* peroxidase from Bacillus, e.g. *B. pumilus* and laccase from Trametes, e.g. *T. versicolor* (previously called Polyporus). It may be preferable to use two different phenol oxidizing enzymes together.

The amount of peroxidase should generally be in the range 10–10,000 PODU per g of dry substance (PODU unit of peroxidase activity defined below). The amount of laccase should generally be in the range 10–10,000 units per g of dry substance (unit of laccase activity defined below).

Molecular oxygen from the atmosphere will usually be present in sufficient quantity. A suitable amount of $H_2O_2$ will usually be in the range 0.01–10 mM, particularly 1–10 mM.

Process Conditions

The enzyme treatment can be done at conventional consistency, e.g. 0.5–10% dry substance, at temperatures of 20–90° C.

Determination of Peroxidase Activity (PODU)

Peroxidase activity is determined from the oxidation of 2,2'-azinobis(3-ethylbenzothiazoline-6-sulfonate) (ABTS) by hydrogen peroxide. The greenish-blue colour produced is photometered at 418 nm. The analytical conditions are 0.88 mM hydrogen peroxide, 1.67 mM ABTS, 0.1 M phosphate buffer, pH 7.0, 30° C., 3 minutes reaction.

1 peroxidase unit (PODU) is the amount of enzyme that catalyses the conversion of 1 $\mu$mol hydrogen peroxide per minute at these conditions.

Determination of Laccase Activity

Laccase activity was determined by a similar method without addition of hydrogen peroxide. 1 unit of laccase activity was defined as the amount of enzyme that catalyses the oxidation of 1 $\mu$mol ABTS per minute.

EXAMPLE 1

6.96 g of a ground wood pulp (GWP) was dissolved in 72 ml 0.1 M buffer (Britton-Robinson buffer consisting of boric acid, phosphoric acid, and acetic acid) at pH 5.5, corresponding to a dry solid content of 1.8 g (2.5%). A laccase from *Polyporus pinsitus* was added to a concentration of 528 laccase units/g dry pulp. The mixture was shaken in a water bath at 50° C. for 2 hours. Subsequently a paper sheet was made from the pulp in a laboratory hand sheet former. The sheet was subsequently pressed and dried in a rapid sheet dryer.

The tear index of the paper sheet was determined, and for comparison a similar experiment was done without any enzyme added. The results were as follows:

| | Invention | Reference |
|---|---|---|
| Tear index ($mN*m^2/kg$) | 4.18 | 3.50 |

EXAMPLE 2

249 g of a ground wood pulp having a dry solid content of 15%, was dissolved 2500 ml 0.1 M buffer similar to the one described in Example 1 at pH 5.5, corresponding to a dry solid content of 1.5%. The mixture was defibrated in a lab-pulper for 5 minutes and thereafter divided into 3 different parts. To one part laccase from *Polyporus pinsitus* was added in the same concentration as in Example 1, to another part inactivated laccase was added, and to the last part water was added. The mixtures were treated for 24 hours at 50° C. Subsequently paper sheets were made as in Example 1, and the tear index and the tensile index were determined. The results were as follows:

| | Reference | inact. laccase | laccase |
|---|---|---|---|
| Tensile index (kNm/kg) | 29.62 | 29.52 | 33.43 |
| Tear index ($mN*m^2/kg$) | 3.29 | 3.35 | 3.57 |

What is claimed is:

1. A method for increasing the strength of a paper or paperboard product produced from a mechanical pulp, the method comprising treating a mechanical pulp with a phenol-oxidizing enzyme system after mechanical refining of said pulp has been completed, under conditions that allow cross-linking of surface lignin in said pulp, wherein said pulp does not contain an added binding agent and wherein a paper or paperboard product produced from the treated pulp exhibits an increased strength relative to a paper product produced from non-treated pulp.

2. The method of claim 1, wherein the treatment is conducted at a pulp consistency of 0.5–10% dry solid content, a pH between 4–10, and a temperature of between 20–90° C.

3. The method of claim 1, wherein the phenol-oxidizing enzyme system is comprised of a peroxidase and hydrogen peroxide.

4. The method of claim 3, wherein peroxidase derived from Coprinus.

5. The method of claim 3, wherein the amount of peroxidase is in the range 10–10,000 PODU per g of dry matter, and the amount of hydrogen peroxide is 0.01–10 mM.

6. The method of claim 3, wherein the peroxidase is derived from Bacillus.

7. The method of claim 1, wherein the phenol-oxidizing enzyme system comprises oxygen and an enzyme selected from the group consisting of laccase and catechol oxidase.

8. The method of claim 7, wherein the laccase is derived from Trametes.

* * * * *